US010420976B2

(12) United States Patent
Blackmore

(10) Patent No.: US 10,420,976 B2
(45) Date of Patent: Sep. 24, 2019

(54) FACILITATED STRETCHING MACHINE

(71) Applicant: Robert F. Blackmore, Lake Oswego, OR (US)

(72) Inventor: Robert F. Blackmore, Lake Oswego, OR (US)

( * ) Notice: Subject to any disclaimer, the term of this patent is extended or adjusted under 35 U.S.C. 154(b) by 0 days.

(21) Appl. No.: 15/454,810

(22) Filed: Mar. 9, 2017

(65) Prior Publication Data

US 2018/0256936 A1 Sep. 13, 2018

(51) Int. Cl.

| | |
|---|---|
| ***A63B 21/00*** | (2006.01) |
| ***A63B 23/035*** | (2006.01) |
| ***A63B 21/062*** | (2006.01) |
| *A63B 23/00* | (2006.01) |
| *A63B 21/055* | (2006.01) |

(52) U.S. Cl.

CPC .... *A63B 21/00185* (2013.01); *A63B 21/0628* (2015.10); *A63B 21/4029* (2015.10); *A63B 21/4034* (2015.10); *A63B 21/4035* (2015.10); *A63B 23/03525* (2013.01); *A63B 23/03583* (2013.01); *A63B 21/0552* (2013.01); *A63B 21/151* (2013.01); *A63B 2023/006* (2013.01); *A63B 2208/0233* (2013.01); *A63B 2208/0238* (2013.01); *A63B 2208/0247* (2013.01); *A63B 2208/0257* (2013.01); *A63B 2225/102* (2013.01)

(58) Field of Classification Search

CPC ..... A63B 21/4039; A63B 21/0615; A63B 21/151; A63B 23/00; A63B 2023/006

See application file for complete search history.

(56) References Cited

U.S. PATENT DOCUMENTS

| | | | | |
|---|---|---|---|---|
| 5,190,509 | A * | 3/1993 | Davison, Jr. ..... | A63B 21/153 482/100 |
| 7,938,760 | B1 | 5/2011 | Webber et al. | |
| 8,172,732 | B1 | 5/2012 | Webber et al. | |
| 2007/0037667 | A1 | 2/2007 | Gordon | |
| 2008/0261783 | A1 | 10/2008 | Andrews | |
| 2010/0279832 | A1 | 11/2010 | Conley et al. | |

OTHER PUBLICATIONS

International Search Report prepared by the United States Patent and Trademark Office for PCT/US2018/018502, dated Jun. 19, 2018, 4 pages.

Written Opinion prepared by the United States Patent and Trademark Office for PCT/US2018/018502, dated Jun. 19, 2018, 5 pages.

* cited by examiner

*Primary Examiner* — Megan Anderson

(74) *Attorney, Agent, or Firm* — Chernoff Vilhauer LLP

(57) ABSTRACT

A system to facilitate stretching for a user, including a force-applying component and a subject-engaging surface, such that the force applying element is attached to a first end of a rotatable element that rotates about a first point of secured support, or fulcrum, and the subject engaging surface is operatively connected to a second end of said rotatable element, such that application of force via the force-applying component causes rotational movement of the subject-engaging surface toward the user.

9 Claims, 3 Drawing Sheets

FACILITATED STRETCHING MACHINE

BACKGROUND OF THE INVENTION

The subject matter of this application relates to equipment that facilitates stretching exercises without the need for help of a personal trainer.

The importance of fitness and exercise is becoming increasingly prevalent within the daily lives of many people beyond those of athletes. Stretching is frequently included within many exercise regimens due to many inherent physical and mental benefits that come with stretching. Some benefits of engaging in a proper stretching regimen include promoting flexibility for daily activity, improving strength, preventing injury, preventing soreness, stimulating blood flow, promoting good posture, and generally promoting body awareness.

Many beneficial stretches, however, require the help of an additional person, or trainer, to position and apply pressure to a targeted muscle or body part to stretch. Individuals who exercise alone often find themselves using stationary implements, or a wall, to stretch against, but methods still do not provide the same level of stretching that a trainer could provide. Attempting stretches alone is especially troublesome for the elderly or those with physical disabilities, because they often may be unable to position themselves to stretch without the help of another individual. In addition, even if an individual is capable of stretching on his or her own, he or she may not have the requisite knowledge of how to stretch. Performing stretches improperly may lead to temporary discomfort, dislocation, or even injury.

BRIEF SUMMARY OF THE INVENTION

In one embodiment, the present invention is a system to facilitate stretching for a user, including a force-applying component and a subject-engaging surface, such that the force applying element is attached to a first end of a rotatable element that rotates about a first point of secured support, or fulcrum, and the subject engaging surface is operatively connected to a second end of said rotatable element, such that application of force via the force-applying component causes rotational movement of the subject-engaging surface toward the user.

In another embodiment, the present invention is a system for promoting stretching, including a first element capable of accepting a weight and a second element having a surface, wherein the first element is operatively connected to the second element such that the accepted weight associated with the first element actuates the surface by rotation about a fulcrum to apply a force against a user's body.

BRIEF DESCRIPTION OF THE SEVERAL VIEWS OF THE DRAWINGS

For a better understanding of the invention, and to show how the same may be carried into effect, reference will now be made, by way of example, to the accompanying drawings, in which.

DETAILED DESCRIPTION OF THE INVENTION

Figure 3:
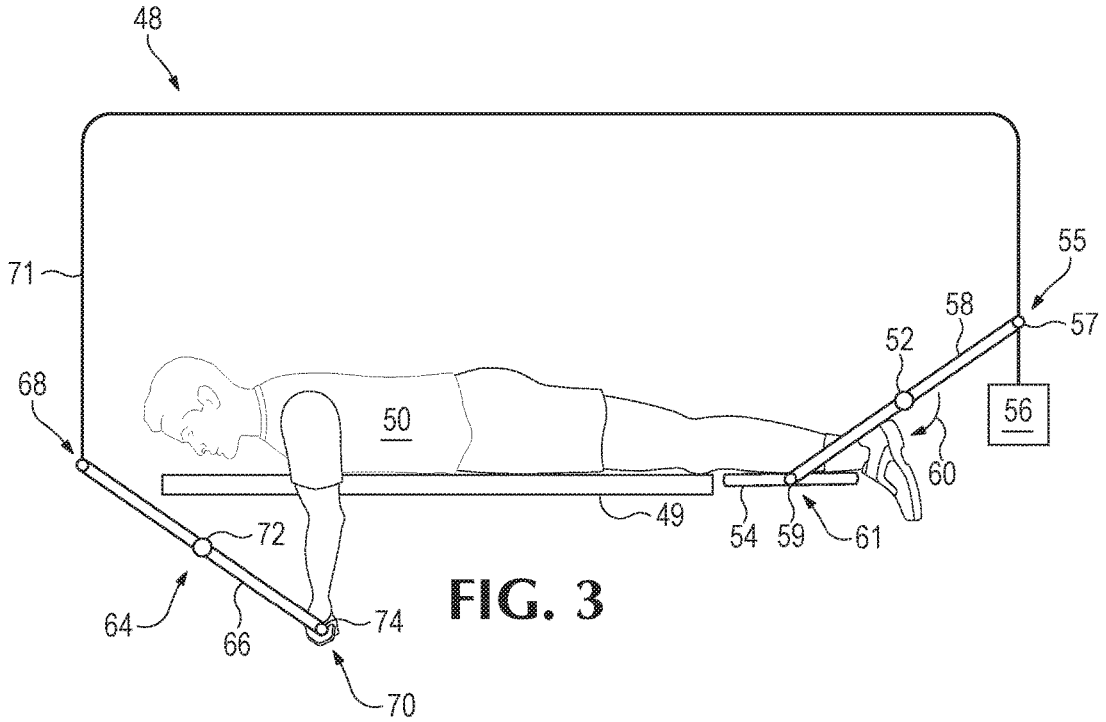
FIG. 3 is a side elevational view of a second embodiment of the invention in a disengaged position.
Figure 4:
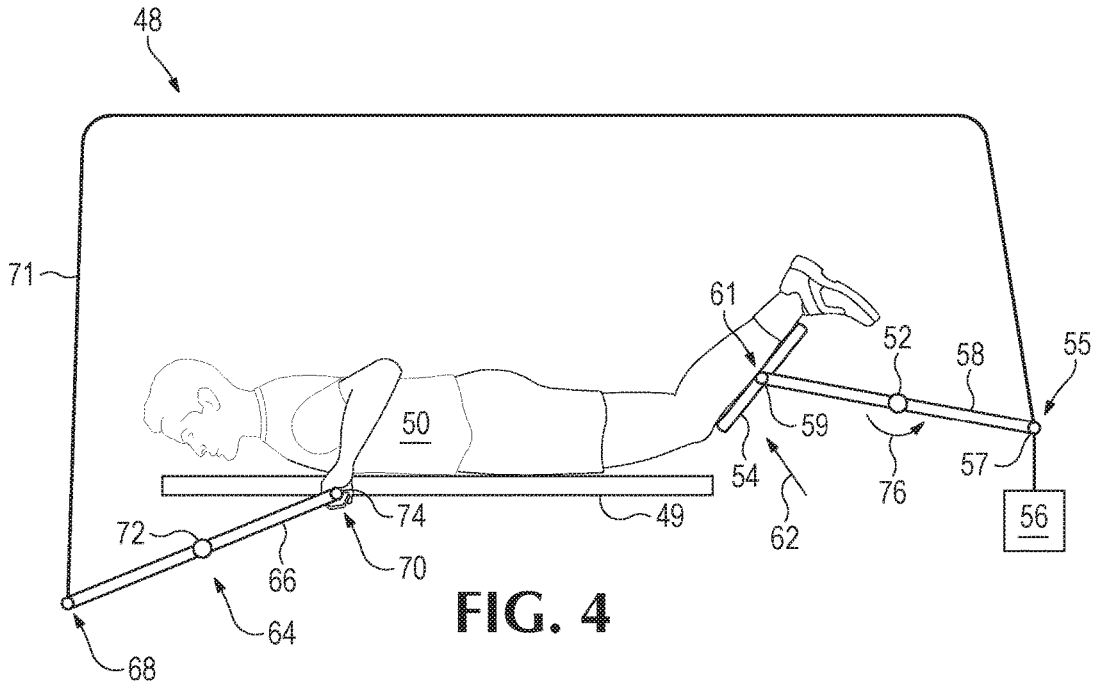
FIG. 4 is a side elevational view of the second embodiment of the invention shown in FIG. 3 in an engaged position.
Figure 6:
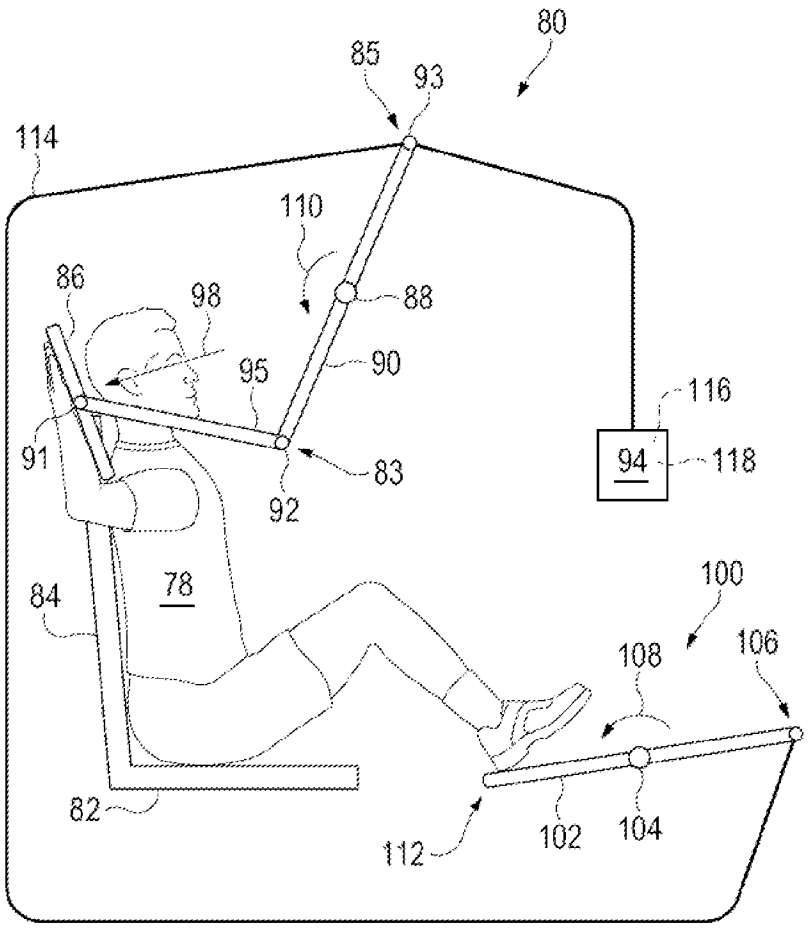
FIG. 6 is a side elevational view of the third embodiment of the invention shown in FIG. 5 in an engaged position.
Figure 5:
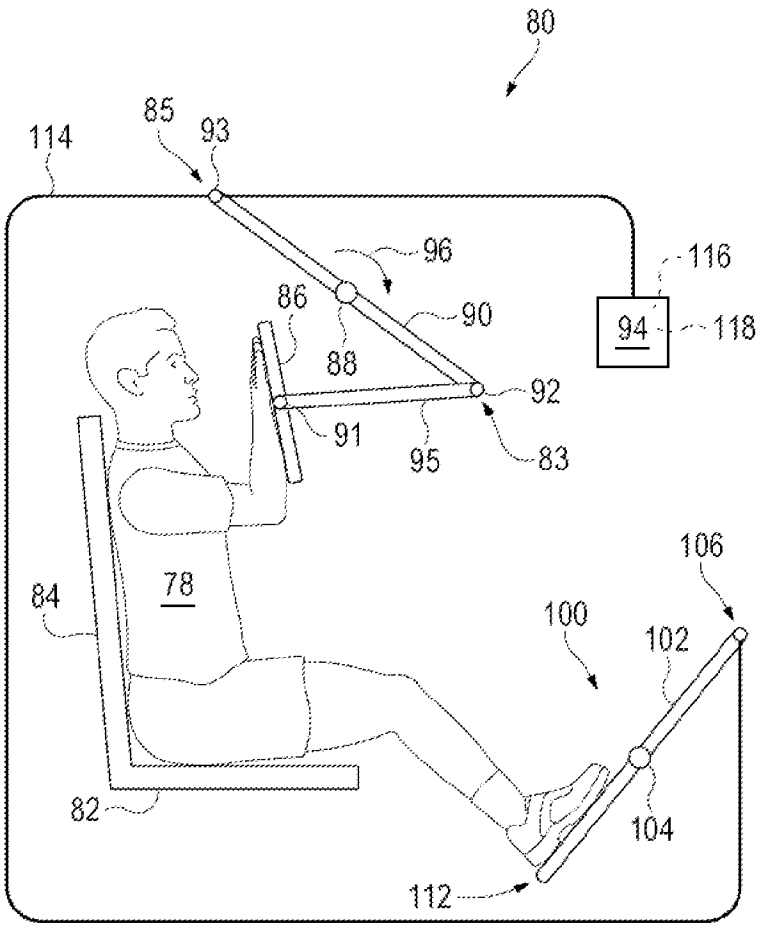
FIG. 5 is a side elevational view of a third embodiment of the invention in a disengaged position.

The accompanying figures represent three embodiments of the present invention. Accordingly, FIGS. 1 and 2 represent a first embodiment of the invention, FIGS. 3 and 4 represent a second embodiment of the invention, and FIGS. 5 and 6 represent a third embodiment of the invention.

Figure 1:
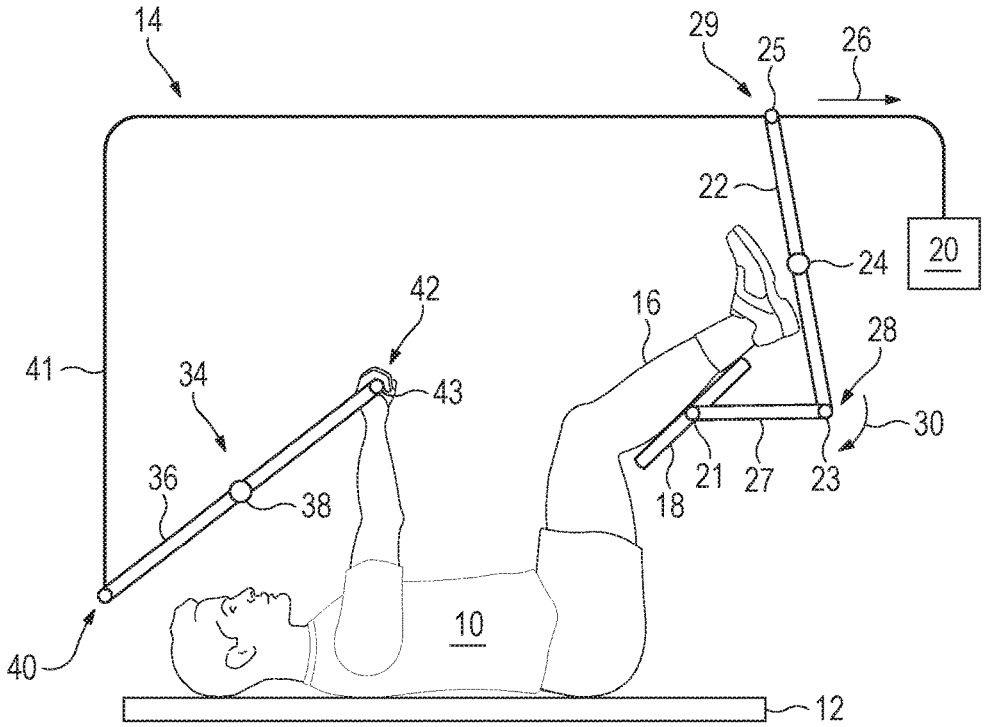
FIG. 1 is a side elevational view of a first embodiment of the invention in a disengaged position.

FIG. 1 shows a user or subject 10 laying on his back on a supporting surface 12. In such a first embodiment, the user 10 interacts with the system 14 by placing one or both legs 16 on a first element, or a subject-engaging surface 18. The surface 18 may be rectangular or be specifically shaped to fit a user's leg or the both of the user's legs. The surface 18 may be operatively connected to a second element, or a force-applying element 20 by a rotatable bar or device 22 that rotates about a first point of secured support, or fulcrum 24, and three pivoting hinges 21, 23, and 25. When the force-applying element 20, is applied, the first end 29 of the rotatable bar 22 moves in the direction of the force, such that the hinge 25 supports rotation in a clockwise direction, represented by the arrow 26 in FIG. 1, about the first fulcrum 24. The second end 28 of the rotatable bar 22 moves in a first rotational direction, the direction represented by arrow 30 in FIG. 1, aided by hinge 23, to apply a force onto the user, as shown in FIG. 2. The combination of hinges 21 and 23, along with elongate element 27, allows for subject-engaging surface 18 to be positioned to support the user's leg(s) as rotatable bar 22 is subjected to the force-applying element 20. Therefore, FIG. 2 shows the system 14 with force applied and with surface 18 on a target part of the user's body, as represented by arrow 32.

Figure 2:
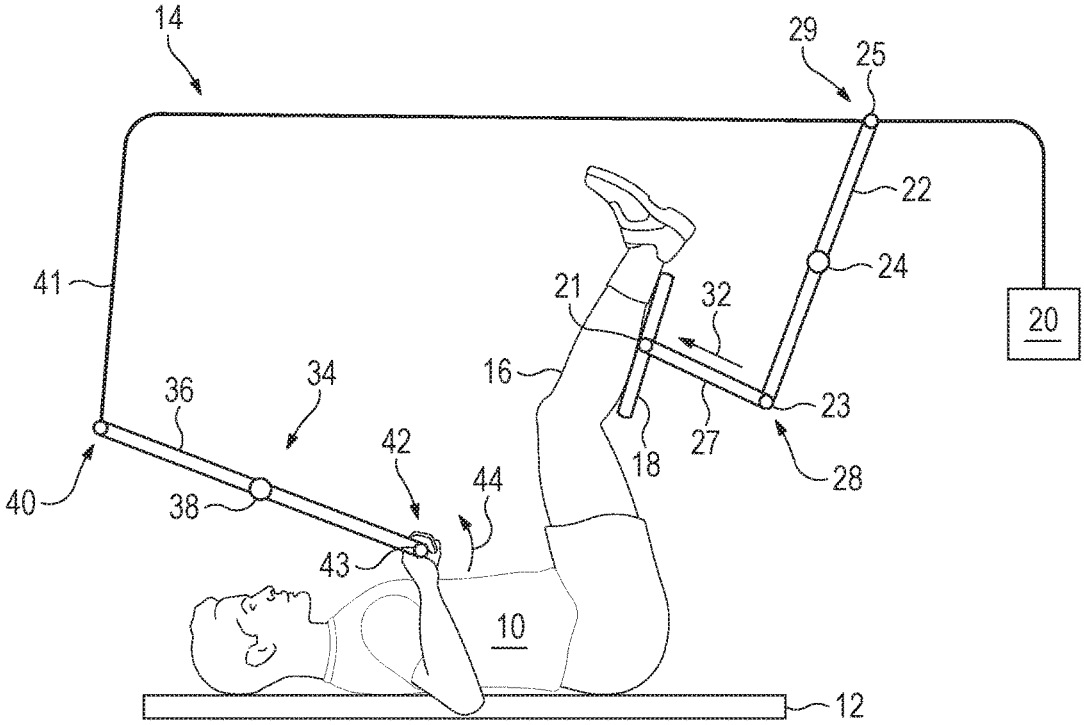
FIG. 2 is a side elevational view of the first embodiment of the invention shown in FIG. 1 in an engaged position.

In the embodiment represented by FIGS. 1 and 2, the system 14 and applied force 32 may function to help a user stretch his or her hamstring or gluteus maximus muscles, by applying pressure on the user's calves, if the user has both legs on the subject-engaging surface 18. If the user has only one leg on the subject-engaging surface 18, the applied force 32 may help the user stretch his hamstring muscles or groin area.

The system 14 may also include a third element, or a force or pressure relief mechanism 34. Such a mechanism 34 may be user-operated to release some, or all, of the force in the direction applied to the target part of the user's body represented by arrow 32. In the embodiment shown in FIGS. 1 and 2, the mechanism 34 may include an elongate bar 36 that is rotatable about a second point of secured support, or fulcrum 38. The first end 40 of the bar 36 can be operatively connected to force-applying element 20 and the rotatable bar 22 via mechanical or electrical connection element 41. Application of force by the force-applying element 20 causes the bar 36 to rotate in a first rotational direction, or clockwise, around the second fulcrum 38. The second end 42 of the bar 36 may have a handle 43 that is accessible to the user 10. By pushing the second end 42 of the bar 36, or handle 43, to rotate the second fulcrum 38 in a second rotational direction, or a counter-clockwise direction, as shown by arrow 44, the connection 41 translates the rotation of the elongate bar 36 to cause the first fulcrum 24 to rotate in a counter-clockwise direction, thereby both rotating the subject-engaging surface 18 away from the target part of the user's body and relieving at least some of the force applied by the force-applying element. In other embodiments of the invention, the connection 41 may function to relieve force by one of either mechanical movement of the first end 29 of the rotatable bar 22 in a counter-clockwise direction or lifting of the force-applying element 20.

FIGS. 3 and 4 represent a second embodiment of the stretching device 48 that may function to stretch a user's 50 hip flexors and/or abdominal muscles and/or other surrounding muscles. In use, the user 50 first lays on his or her stomach on a surface 49. The stretching device 48 may have a first point of secured support, or fulcrum 52 that is operatively connected to subject-engaging surface 54. Similar to the device 14, a force-applying element 56 may be used to selectively apply force to a user's target body part(s) with the use of rotatable bar or device 58, and hinges 57 and 59. In this embodiment of the present invention, application of a force causes the first end 55 of the rotatable bar 58 to rotate about the first fulcrum 52 in a first rotational direction, or a clockwise manner, as represented by arrow 60, pivoting about both hinges 57 and 59, and causing the second end 61 of the rotatable bar 58 to apply pressure to the user 50 via the subject engaging surface 54. Such rotation causes the subject-engaging surface 54 to translate the applied force to the user and lift the user's legs as represented by arrow 62 and shown in FIG. 4. The subject-engaging surface continues to support the subject's by rotation about hinge 59 as the rotatable bar 58 rotates. FIG. 4 therefore represents an embodiment of the present invention in which the applied force to a user's shins or other lower leg area is aiding the user to stretch his or her hip flexors or other surrounding muscles.

The device 48 may also include a force or pressure-relieving mechanism 64. Such a mechanism may include an elongate bar 66 having a first end 68 and a second end 70. The first end 68 may be operatively connected to either or both the subject-engaging surface 54 and the force-applying element 56 via a mechanical or electrical connection 71. The elongate bar 66 is rotatable about a second point of secured support, or fulcrum 72 and may have a grippable handle 74 located at the second end 70 of the elongate bar 66. If a user 50 is using the device 48 such that he or she is stretching as represented by FIG. 4, the user may relieve at least some of the pressure resulting from rotation as represented by arrow 62 by pushing the second end 70 of the elongate bar 66, or handle 74, downward to force a clockwise rotation of the elongate bar 70 about the second fulcrum 72. By doing so, the rotatable bar 58 rotates about the first fulcrum 52 in a second rotational direction or a counter-clockwise direction 76, and relieves pressure at the subject 54.

A third embodiment of the present in FIGS. 5 and 6 shows a user 78 using a third stretching device 80 for stretching the user's 78 upper body. In such an embodiment, the user 78 may be positioned in a seat 82 having a back support 84 that may function to resist pressure applied by the subject engaging surface 86. The subject-engaging surface 86 is operatively connected to a first point of secured support, or fulcrum 88 via a rotatable bar or device 90, hinges 91 and 92, and elongate element 95. As viewable in FIGS. 5 and 6, one end 83 of the rotatable bar 90 is operatively connected to the subject engaging surface 86 via a hinge 92. The opposing end 85 of the rotatable bar 90 is connected to a force-applying element 94 via a hinge 93, such that when force is applied by the force-applying element 94, the bar 90 rotates in a first rotational direction, or a clockwise direction, as represented by arrow 96. Therefore, when force is selectively applied via the force-applying element 94, the bar 90 rotates in a clockwise direction, thereby moving the subject-engaging surface 86 against the user and applying pressure at a user-selected target, as represented by arrow 98 in FIG. 6. FIG. 6 shows the user 78 in an engaged, stretching position. The device 80 may be used to apply force toward the user's 78 upper arms to stretch the user's chest, or other upper body regions.

Similar to the first and second embodiments described herein, the third embodiment may also include a force-relieving mechanism 100. Such a mechanism may include an elongate bar 102 that is rotatable around a second point of secured support, or fulcrum 104. A first end 106 of the elongate bar 102 may be connected to either or both the rotatable bar 90 and the force applying element 94. In the embodiment shown herein, the end 106 of the elongate bar 102 is operatively connected to both the rotatable bar 90 and the force applying element 94 via a connection 114 such that the user may urge the elongate bar 102 in a second rotational direction, or a counter clockwise direction 108. Such rotation of the elongate bar 102 in turn causes the rotatable bar 90 to rotate in a second rotational direction, or a counter clockwise direction, as represented by arrow 110 and therefore relieves some or all of the pressure applied by the subject engaging surface 86. A second end 112 of the elongate bar 102 may be shaped to accept a user's foot, in some embodiments of the invention, the second end may be coated to minimize the potential for slippage during use.

The force-applying element 20, 56 or 94 may comprise a mechanical device which is capable of accepting one or more weights 116 (such as shown in FIGS. 5-6). The force-applying element may also be an electrically-automated device 118 (such as shown in FIGS. 5-6), which can selectively apply a force to the associated stretching device based on the user's preference. The force-applying element may also be one or more, or a combination of, power bands, power rods and springs, configured to be able to apply a force. The amount of weight or level of force applied may be selected based on the type and level of stretching that the user desires.

Embodiments of the present invention provide a variety of uses that facilitate assisted stretching exercises. Such embodiments may include stretches that promote athletic stretches, weight and strength training stretches, flexibility and muscle stabilization and yoga and pilates stretches. Stretches for various individual goals may use the disclosure herein to direct a force to a target body region to promote targeting stretching, beyond the examples shown in the figures herein.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. A system to facilitate stretching for a user, comprising a seat;

a back support;

a first fulcrum attached to a rotatable bar wherein a surface is operatively connected to a first end of the rotatable bar and a force-applying element is operatively attached to a second end of the rotatable bar, wherein the force-applying element applies a first force that causes the rotatable bar to rotate in a first rotational direction, toward the back support and away from the force-applying element around the first fulcrum;

a second fulcrum attached to an elongate bar having a first end and a second end, wherein the first end of the elongate bar is operatively connected to the force-applying element such that the elongate bar rotates in the first rotational direction around the second fulcrum when the first force is applied, wherein both the seat and back support remain stationary when the rotatable bar and the elongate bar rotate in the first rotational direction, wherein the rotatable bar and the elongate bar are positioned relative to the seat such that, when the user is sitting on the seat, the surface of the rotatable bar is positioned to be engaged by at least one of the user's upper limbs and the elongate bar is positioned to be engaged by at least one of the user's lower limbs.

2. The system of claim 1 wherein the first rotational direction is clockwise.

3. The system of claim 1 wherein the force-applying element is a mechanical device structured to accept one or more weights.

4. The system of claim 1 wherein the surface is positioned to move toward the user's calf when the rotatable bar rotates in the first rotational direction.

5. The system of claim 1 wherein the surface is positioned to move toward the user's shin when the rotatable bar rotates in the first rotational direction.

6. The system of claim 1 wherein the surface is positioned to move toward a chest of the user when the rotatable bar rotates in the first rotational direction.

7. The system of claim 1 wherein the second end of the elongate bar includes a user-accessible handle.

8. The system of claim 1, wherein the surface is a planar surface sized to engage both a hand and a portion of the forearm of the user.

9. The system of claim 1, wherein the rotatable bar rotates in a second rotational direction opposite the first rotational direction when the user applies a second force to rotate the elongate bar in the second rotational direction against the first force applied by the force-applying element, wherein both the back support and seat remain stationary when the rotatable bar and the elongate bar rotate in the second rotational direction.

* * * * *